United States Patent [19]

Peter

[11] 4,357,782

[45] Nov. 9, 1982

[54] DOMED SUPPORT FRAMEWORK OR TRUSS

[76] Inventor: Emil Peter, Dammweg, Marthalen, Switzerland

[21] Appl. No.: 160,608

[22] Filed: Jun. 18, 1980

[30] Foreign Application Priority Data

Jun. 22, 1979 [CH] Switzerland ..... 5882/79

[51] Int. Cl.[3] ..... E04B 7/12

[52] U.S. Cl. ..... 52/18; 52/86; 52/644

[58] Field of Search ..... 52/18, 86, 83, 644, 52/639, 642

[56] References Cited

U.S. PATENT DOCUMENTS

| | | | |
|---|---|---|---|
| 1,983,874 | 12/1934 | Pratt | 52/644 |
| 3,247,629 | 4/1966 | Behlen | 52/86 |
| 4,275,537 | 6/1981 | Pinson | 52/644 |

FOREIGN PATENT DOCUMENTS

| | | | |
|---|---|---|---|
| 160077 | 1/1941 | Fed. Rep. of Germany | 52/18 |
| 1135152 | 8/1915 | Fed. Rep. of Germany | 52/86 |
| 863819 | 4/1941 | France | 52/86 |
| 993050 | 10/1951 | France | 52/644 |
| 438652 | 12/1967 | Switzerland | 52/86 |
| 674000 | 6/1952 | United Kingdom | 52/86 |

*Primary Examiner*—Price C. Faw, Jr.
*Assistant Examiner*—Henry E. Raduazo
*Attorney, Agent, or Firm*—Diller, Ramik & Wight

[57] ABSTRACT

A domed support framework or truss comprises, as the roof form elements, wooden members oriented in the direction of doming and interconnected with one another so as to be tension-proof in such direction. The therebetween extending reinforcement ribs are likewise tension-proof wooden or timber elements. At their ends the roof form elements of the tension dome are frictionally connected with a tension element which extends in a polygon or catenary configuration between two supports to the same dome side and is guided over such supports in the compression dome. At that location the tension element is anchored at the extension of the compression dome. This construction compensates the horizontal thrust of the domed support framework, by virtue of the anchoring of the tension elements, without loading the roof form elements in the transverse direction, and thus, renders possible the use of materials which only can be loaded in one direction in tension, such as for instance wood.

16 Claims, 8 Drawing Figures

Fig. 6
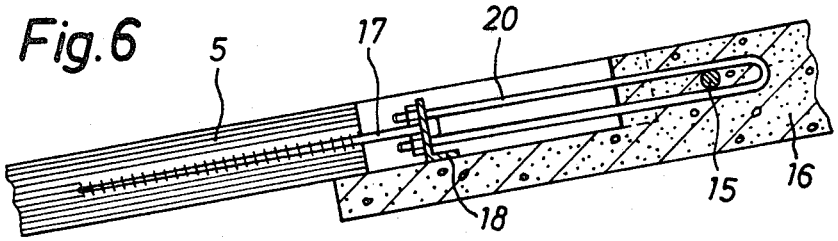
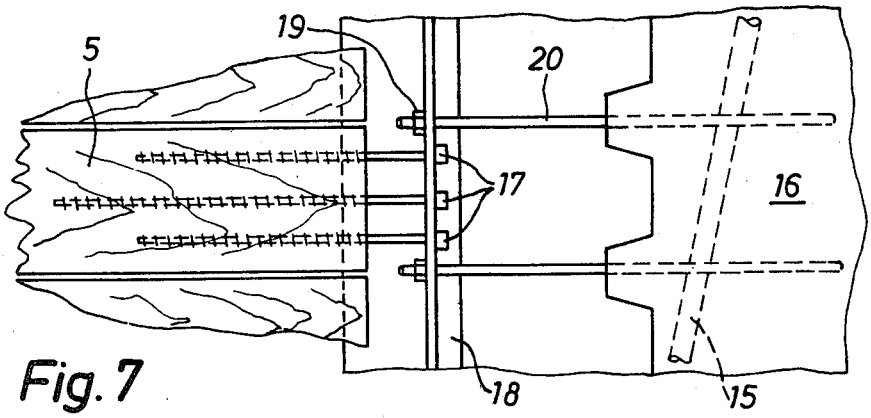
Fig. 7
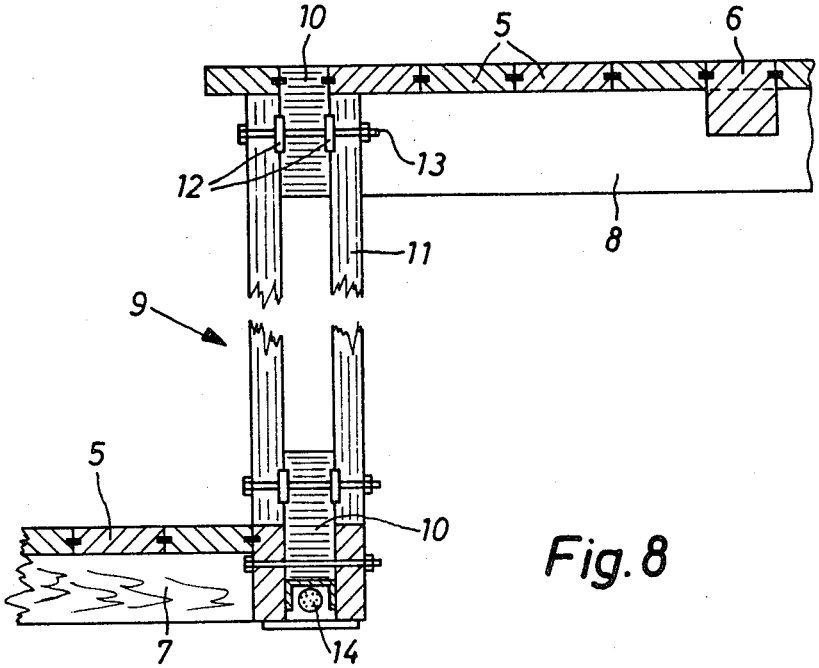
Fig. 8

DOMED SUPPORT FRAMEWORK OR TRUSS

BACKGROUND OF THE INVENTION

The present invention relates to a new and improved construction of an arched or domed support framework or truss, especially for roof constructions, which is of the type comprising at least one respective compression arch or dome and tension arch or dome, which are oppositely arched in one direction, arranged adjacent one another in the arching direction and at their ends mounted upon common supports.

A support framework of the aforementioned type has been disclosed, for instance, in German Patent Publication No. 2,752,222. With this heretofore known arrangement pre-tensioning cables extend over the entire length of the tension arch or dome. These pre-tensioning cables take-up, while functioning as tensioning elements, the inherent weight of the construction as well as the dome loads and transmit such to supports. The horizontal thrust is compensated by anchoring the pre-tensioning cable in the compression dome.

This heretofore known construction, which is suitable for large span widths, is afflicated with the drawback that the requisite long tension cables are expensive. Furthermore, the drawing-in of such long tensioning cables into the hollow profile members, through which they extend, is quite difficult.

SUMMARY OF THE INVENTION

Therefore, it is a primary object of the present invention to render possible the above described supporting mode, without resorting to the use of longer tensioning cables, by means of conventional structural materials, such as for instance wood, which can be loaded in compression and tension.

Now in order to implement these and still further objects of the invention, which will become more readily apparent as the description proceeds, the invention contemplates that the compression dome and the tension dome are provided with roof form elements and reinforcement ribs which are oriented in the arching or doming direction and can be loaded in such direction in tension as well as compression, wherein such components are frictionally or positively connected with at least one catenary or polygon configured tension element at their ends at the tension dome. This tension element extends between common supports at the surface of the tension dome, is guided over such supports to the compression dome and is anchored at its extension.

According to an advantageous construction of the invention the roof form and the reinforcement ribs comprise mutually interconnected wooden or timber elements which are tension resistant and compression resistant in the arching direction.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 6 is a cross-sectional view taken along the line VI—VI of FIG. 1;

FIG. 7 is a schematic front view of the domed support framework at the location illustrated in FIG. 6; and FIG. 8 is a sectional view taken along the line VIII—VIII of FIG. 1.

DETAILED DESCRIPTION OF THE PREFERRED EMBODIMENTS

Figures 1, 2, 3, 4, 5:
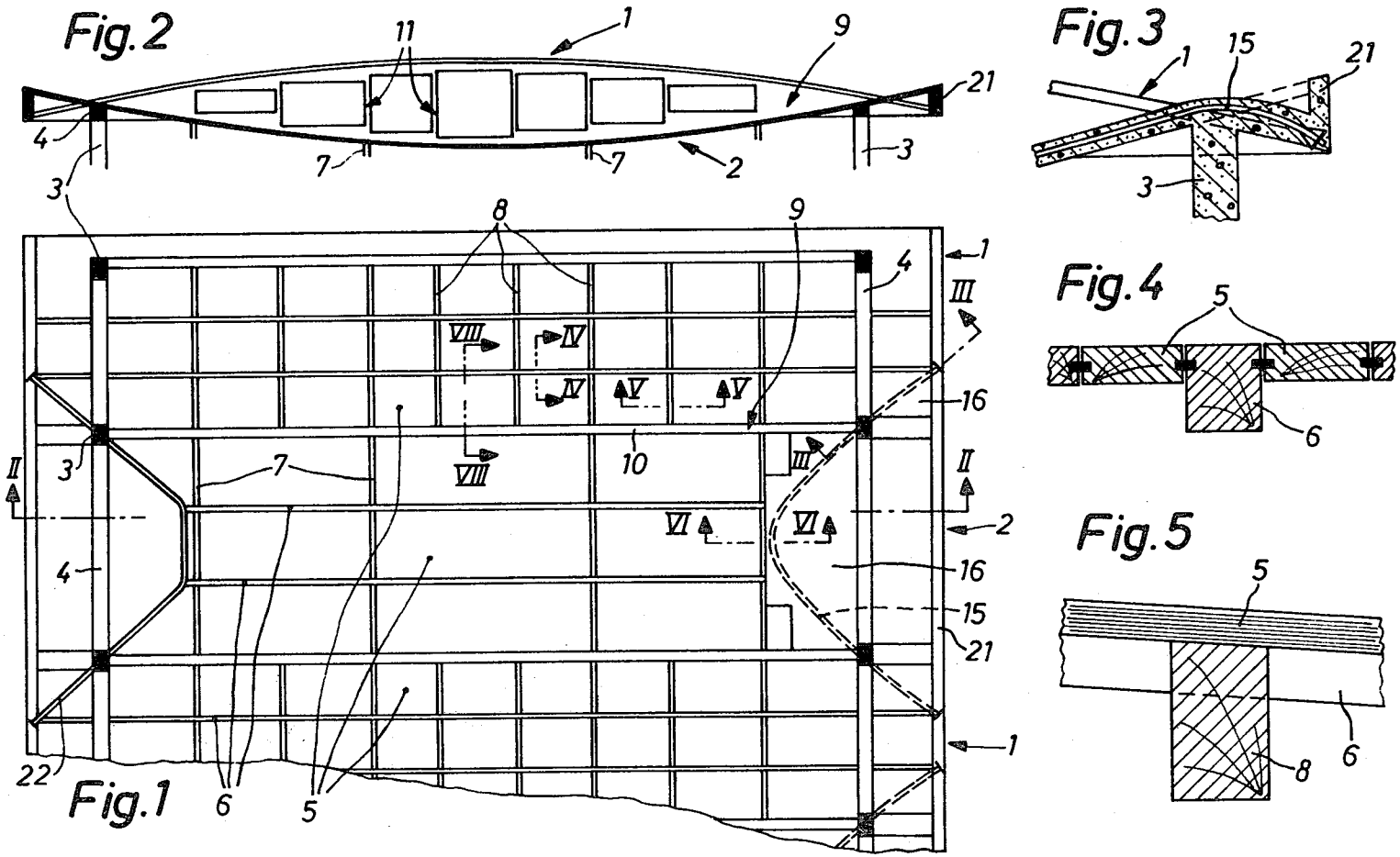
FIG. 1 is a bottom plan view of a domed support framework or truss constructed according to the present invention.
FIG. 2 is a longitudinal sectional view through the tension dome or arch of the domed or arched support framework, taken substantially along the line II—II of FIG. 1.
FIG. 3 is a cross-sectional view taken along the line III—III of FIG. 1.
FIG. 4 is a cross-sectional view taken along the line IV—IV of FIG. 1.
FIG. 5 is a cross-sectional view taken along the line V—V of FIG. 1.

Describing now the drawings, the invention is predicated upon the fact that under the conventional structural materials there are those which, in relation to their inherent weight, have an extremely high tensile strength in one direction. A material of this type is wood or timber, which in the direction of the fibers has high tension strength, but transverse to the direction of the fibers an extremely low tension strength.

In the case of sheet metal steel profiles the same holds true. In order to accommodate such strength characteristics, the roof form elements and reinforcement ribs are oriented such that the direction of their greatest tensile strength extends in the arching or doming direction. The construction is accomplished in a manner such that the forces prevailing by virtue of the inherent weight forces and possible loads essentially extend in this direction and thus are taken-up by the roof form elements and the reinforcement ribs themselves, as the case may be.

The domed support framework, as best seen by referring to FIGS. 1 and 2, alternately comprises compression arches or domes 1 and tension arches or domes 2. They are supported upon the supports or support elements 3, wherein in each case the support elements at the boundary lines between the compression dome 1 and the tension dome 2 are common to both. The support elements 3 are interconnected with one another by means of horizontal supports 4.

The compression domes or arches 1 and the tension domes or arches 2 possess a roof form composed of roof form elements 5 and reinforcement ribs 6 which extend in the direction of doming or arching.

With the illustrated exemplary embodiment the roof form elements 5 and the reinforcement ribs 6 comprise form boards and ribs formed of wood, wherein the fiber direction extends in the arching or doming direction and these components are connected to be tension resistant with one another in the aforementioned direction. The tension-proof or tension resistant connection joints can be designed in most different ways, mechanically by wooden screws or molded rib steel anchors, or, however, by heat resistant adhesive means or glue. In the transverse direction the form boards 5 are connected with one another and also the form boards 5 are connected with the reinforcement ribs 6 by tongue-and-grooves. In this respect it is to be observed that between these components there are to be left joints in the transverse direction, in order to be able to compensate dimensional changes of the wood in the transverse direction which can arise due to weather effects.

As the roof form there also can be employed sheet metal steel profile members which are connected with one another to be tension resistant in the doming direction or appropriately mounted steel clay boards. Narrow and long structural elements are particularly suitable for the construction design. Generally, it is mentioned that as the roof form elements there can be employed structural or building elements which, in their lengthwise direction, have a great tension and compression resistance in relation to their inherent weight.

In order to take-up unequally distributed roof loads at the tension dome 2, for instance caused by snow or wind, it is possible to mount ribs 7, likewise formed of wood, which extend transverse to the arching direction. In corresponding manner the compression dome or arch 1 can be provided with ribs 8 safeguarding against kinking or the like. The ribs 7 and 8 serve for taking-up and transmitting forces to reinforcement supports or carriers 9 extending between the compression dome 1 and the tension dome 2. The reinforcement supports or carriers 9 are formed by the edge reinforcement ribs 10 of the compression and tension domes, respectively, these ribs being interconnected by window columns 11. The connection of the window columns 11 with the edge reinforcement ribs 10 is preferably accomplished by means of ring pegs or dowels 12, which can take-up shear forces, as well as by threading by means of the threaded screws or bolts 13. When working with larger dome span widths and for extensively avoiding deformations and for increasing the stability, there can be drawn a round steel tension anchor or a pre-tensioning cable 14 into the tension boom of the connector-reinforcement support 9. At the right-hand portion of the showing of FIG. 1 there has been illustrated a first possibility for securing the roof form and the reinforcement ribs 6 of the tension dome 2, these reinforcement ribs 6 extending in the direction of arching. On the other hand, at the left-hand portion of FIG. 1 there has been illustrated a second possible construction.

Initially, there will be explained the variant embodiment shown at the right-hand portion of FIG. 1, which is advantageously employed for accommodating large dome span widths. Between neighboring supports there extends in a catenary configuration a tension element 15 in the form of a pre-tensioning cable formed of high-grade steel chord wires, which is guided in a hollow profile. The hollow profile together with the pre-tensioning cable extends in reinforced concrete 16. Anchored in a tension resistant manner in the reinforced concrete 16 are the form elements 5 and the ribs 6. In FIGS. 6 and 7 there has been illustrated in greater detail one attachment possibility. By means of wooden screws or molded rib steel anchors 17 the form elements 5 and the ribs 6, respectively, are secured in a tension resistant manner at a L-profile member or profile 18. This profile member 18 is secured, in turn, by means of the anchors 20 which extend in the reinforced concrete 16 and about the tension element 15. The anchors or anchoring elements 20, possess at their dome-side ends, threading for receiving nut members 19, by means of which there can be displaced the L-shaped profile member 18 during the erection and in the arching direction.

The pre-tensioning cable 15 extends over the supports 3 in the pressure or compression dome 1 and transmits the vertical load to the dome directly at the supports 3. By means of this arrangement the horizontal thrust of the dome is compensated. The pre-tensioning cable 15 is anchored at the region of one rib of the compression dome with conventional anchoring means. The anchoring region with the reinforcement ribs 21 is thus preferably designed in pre-stressed concrete.

During the erection work, after mounting the roof form elements, the pre-tensioning cable 15 is pre-tensioned during a first phase. After applying the roof skin and the insulation there is accomplished, during a second phase or stage, a further pre-tensioning. After completion of the pre-tensioning it is possible to press-out the enveloping tube of the pre-tensioning cable by means of injection cement mortar, so that there is formed a composite structure.

With the embodiment shown in FIG. 2 at the left-hand portion thereof, which is particularly suitable for smaller dome span widths, there is used as the tension element a circular steel cable 22 configured in the form of a funicular polygon extending over the supports 3 in the extension of the compression dome 1. The cable 22 is connected in a tension resistant manner with the form elements 5 and the ribs 6 and transmits the vertical loads of the dome to the supports 3. The circular steel tension element 22 is likewise anchored at the region of a rib 6 at the compression or pressure dome 1.

The roof form composed of compression and tension domes or arches, is provided in conventional manner with insulation layers and a roof skin.

By means of the invention it is possible, while optimumly utilizing the advantageous properties of conventional building or structural materials, such as wood, to obtain a domed or arched support framework or truss of simple design.

Due to the anchoring of the tension elements 15, 22 in the compression or pressure dome 1 there can be compensated the horizontal thrust of the domed support framework, without loading the roof form elements in transverse direction, whereby it is possible to use the above disclosed building materials, which essentially can be loaded in tension in one direction.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A domed support framework, especially for roof constructions, comprising:

at least one compression dome;

at least one tension dome;

said compression and tension domes being arched oppositely with respect to one another in one direction and adjacently arranged in the arching direction;

common support means for supporting the ends of said domes;

roof form elements and reinforcement ribs provided for said compression and tension domes;

said roof form elements and reinforcement ribs being oriented in the arching direction and in such direction being loaded both in tension and compression;

at least one tension element at each end of the tension dome extending substantially transversely to the arching direction and transversely spanning said at least one tension dome with which there are connected the roof form elements and reinforcement ribs;

and said at least one tension element extending between said common support means in the surface of the tension dome, being guided over said common support means to the compression dome and being anchored at an extension of said compression dome.

2. The domed support framework as defined in claim 1, wherein:

said at least one tension element possesses a substantially catenary configuration.

3. The domed support framework as defined in claim 1, wherein:

said at least one tension element possesses a configuration in the form of a funicular polygon.

4. The domed support framework as defined in claim 1, wherein:

said roof form elements and reinforcement ribs are frictionally connected at the ends of the tension dome.

5. The domed support framework as defined in claim 1, wherein:

said compression dome and said tension dome are arched in a catenary configuration.

6. The domed support framework as defined in claim 1, further including:

wooden elements for interconnecting with one another in a tension resistant and compression resistant manner the roof form elements and reinforcement ribs.

7. The domed support framework as defined in claim 1, wherein:

said roof form elements and said reinforcement ribs comprise sheet metal steel profile elements.

8. The domed support framework as defined in claim 1, wherein:

said roof form elements and said reinforcement ribs comprise prefabricated concrete elements.

9. The domed support framework as defined in claim 1, wherein:

the dome ends comprise a respective rib-shaped reinforcement rib, constructed as a roof cornice, and extending essentially over the entire dome width.

10. The domed support framework as defined in claim 1, wherein:

each of said tension elements comprises a pre-tension cable and the dome ends are formed in reinforced concrete.

11. The domed support framework as defined in claim 1, further including:

window column means for interconnecting marginal reinforcement ribs of the compression dome and neighboring tension dome with one another and collectively forming a reinforcement support means.

12. The domed support framework as defined in claim 11, wherein:

said reinforcement support means has a tension boom provided with a circular steel tension anchor.

13. The domed support framework as defined in claim 11, wherein:

said reinforcement support means contains a tension boom comprising a pre-tensioning cable.

14. The domed support framework as defined in claim 1, further including:

rib means extending transversely with respect to the direction of arching provided for each of the compression dome and tension dome; and said rib means serving for securing the compression dome against kinking and for taking-up unequally distributed roof loads at the tension dome.

15. A domed support framework, especially for roof constructions, comprising:

at least one compression dome;

at least one tension dome; said compression and tension domes being arched oppositely with respect to one another in one direction and adjacently arranged in the arching direction;

common support means for supporting the ends of said domes;

roof form elements and reinforcement ribs provided for said compression and tension domes;

said roof form elements and reinforcement ribs being oriented in the arching direction and in such direction being loaded both in tension and compression;

at least one tension element at each end of the tension dome extending substantially transversely to the arching direction and transversely spanning said at least one tension dome with which there are connected the roof form elements and reinforcement ribs; and said at least one tension element extending between said common support means in the surface of the tension dome, being guided over said common support means to the compression dome and being anchored at said compression dome.

16. A domed support framework, especially for roof constructions, comprising:

at least two adjacent but spaced compression domes;

at least one tension dome between said compression between said compression domes;

said compression and tension domes being arched oppositely with respect to one another in one direction;

common support means for supporting the ends of said domes;

roof form elements and reinforcement ribs provided for said compression and tension domes;

said roof form elements and reinforcement ribs being oriented in the arching direction and in such direction being loaded both in tension and compression;

at least one tension element at each end of the tension dome extending substantially transversely to the arching direction and transversely spanning said at least one tension dome and at least portions of said compression domes;

at least one tension element with which there are connected the roof form elements and reinforcement ribs; and said at least one tension element extending between said common support means in the surface of the tension dome, being guided over said common support means to the compression domes and being anchored at said compression domes.

* * * * *